US010161187B2

(12) United States Patent
Gawski et al.

(10) Patent No.: US 10,161,187 B2
(45) Date of Patent: Dec. 25, 2018

(54) ROTOR BEARING FOR PROGRESSING CAVITY DOWNHOLE DRILLING MOTOR

(71) Applicant: HALLIBURTON ENERGY SERVICES, INC., Houston, TX (US)

(72) Inventors: Victor Gawski, Aberdeenshire (GB); John Kenneth Snyder, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 86 days.

(21) Appl. No.: 14/915,180

(22) PCT Filed: Sep. 30, 2013

(86) PCT No.: PCT/US2013/062676
§ 371 (c)(1),
(2) Date: Feb. 26, 2016

(87) PCT Pub. No.: WO2015/047405
PCT Pub. Date: Apr. 2, 2015

(65) Prior Publication Data

US 2016/0208556 A1 Jul. 21, 2016

(51) Int. Cl.
*E21B 4/02* (2006.01)
*E21B 4/00* (2006.01)
(Continued)

(52) U.S. Cl.
CPC ..... *E21B 4/003* (2013.01); *E21B 4/02* (2013.01); *F01C 21/02* (2013.01); *F04C 2/1071* (2013.01);
(Continued)

(58) Field of Classification Search
CPC ..... E21B 4/003; E21B 4/02
(Continued)

(56) References Cited

U.S. PATENT DOCUMENTS 4,913,234 A 4/1990 Bodine
5,139,400 A 8/1992 Ide
(Continued)

FOREIGN PATENT DOCUMENTS

CN 101307674 A 11/2008
EP 0450056 A1 10/1991
(Continued)

OTHER PUBLICATIONS

International Application No. PCT/US2012/46857, entitled "A System and Method for Wireline Tool Pump-Down Operations," filed Jul. 16, 2012, 31 pages.
(Continued)

*Primary Examiner* — Taras P Bemko
(74) *Attorney, Agent, or Firm* — Alan Bryson; Parker Justiss, P.C.

(57) ABSTRACT

A progressing cavity drilling motor positionable in a wellbore includes a tubular housing, a stator having a collection of helical lobes, and a rotor having a collection of helical lobes. The rotor orbits about the central longitudinal axis of the stator. A bearing assembly is coupled to an end of the housing and is disposed around an end of the rotor. The bearing assembly includes a bearing housing disposed concentrically in the stator housing, an outer bearing disposed concentrically in the bearing housing, and an inner bearing disposed on the first cylindrical end of the rotor. The inner bearing has a central axis aligned with the central axis of the rotor and is positioned in the outer bearing such that the inner bearing orbits around the central longitudinal axis of the stator when the rotor is rotated in the stator.

18 Claims, 4 Drawing Sheets

(51) Int. Cl.
*F01C 21/02* (2006.01)
*F04C 2/107* (2006.01)

(52) U.S. Cl.
CPC ..... *F04C 2240/50* (2013.01); *F04C 2240/60* (2013.01)

(58) Field of Classification Search
USPC ..... 175/57
See application file for complete search history.

(56) References Cited

U.S. PATENT DOCUMENTS

| | | | |
|---|---|---|---|
| 5,439,359 | A | 8/1995 | Leroy et al. |
| 6,905,319 | B2 | 6/2005 | Guo |
| 6,913,095 | B2 | 7/2005 | Krueger |
| 7,503,403 | B2 | 3/2009 | Jogi et al. |
| 7,748,466 | B2 | 7/2010 | Aivalis et al. |
| 7,849,927 | B2 | 12/2010 | Herrera |
| 8,376,616 | B2 | 2/2013 | Pheasey |
| 2002/0074167 | A1 | 6/2002 | Plop |
| 2005/0211471 | A1 | 9/2005 | Zupanick |
| 2005/0269885 | A1 | 12/2005 | Knox et al. |
| 2007/0046119 | A1 | 3/2007 | Cooley |
| 2010/0038142 | A1 | 2/2010 | Synder et al. |
| 2010/0218995 | A1 | 9/2010 | Sexton et al. |
| 2010/0239446 | A1 | 9/2010 | Rec |
| 2011/0120725 | A1 | 5/2011 | Downton et al. |
| 2012/0132470 | A1 | 5/2012 | Jarvis et al. |
| 2012/0177313 | A1* | 7/2012 | Beauchamp ..... E21B 33/085 384/462 |

FOREIGN PATENT DOCUMENTS

| | | |
|---|---|---|
| WO | WO 1991/005939 | 5/1991 |
| WO | WO 2011/037561 | 3/2011 |
| WO | WO 2012/122321 A3 | 2/2013 |

OTHER PUBLICATIONS

Samuel et al., "Analytical Study of the Performance of Positive Displacement Motor (PDM): Modeling Incompressible Fluid," Society of Petroleum Engineers, SPE 39026-MS, Latin American and Caribbean Petroleum Engineering Conference, Aug. 30-Sep. 3, 1997, Rio De Janeiro, Brazil, 11 pages.

Saveth et al., "The Progressing Cavity Pump: Principal and Capabilities," Society of Petroleum Engineers, SPE 18873-MS, SPE Production Operations Symposium, Mar. 13-14, 1989, Oklahoma City, Oklahoma, 6 pages.

PCT International Preliminary Report on Patentability, PCT/US2013/062676, dated Apr. 14, 2016, 12 pages.

PCT/US2013/062676 International Search Report/Written Opinion dated Jun. 30, 2014, 15 pages.

* cited by examiner 10
14
12
60
25
20
32
34
21
100a
24
22
26
100b
102
40
45
50

ROTOR BEARING FOR PROGRESSING CAVITY DOWNHOLE DRILLING MOTOR

TECHNICAL FIELD

This document generally describes bearing assemblies for rotational equipment positionable in a wellbore, more particularly a bearing assembly for the rotor of a progressing cavity downhole drilling motor.

BACKGROUND

Progressing cavity motors, also known as Moineau-type motors having a rotor that rotates within a stator using pressurized drilling fluid, have been used in wellbore downhole drilling applications for many years. These motors are sometimes referred to in the art as downhole mud motors. Pressurized drilling fluid (e.g., drilling mud) is typically supplied via a drill string to the motor. The pressurized fluid flows into and through a plurality of cavities between the rotor and the stator, which generates rotation of the rotor and a resulting torque. The resulting torque is typically used to drive a working tool, such as a drill bit for penetrating geologic formations in the wellbore.

In oil and gas exploration it is important to protect the structural integrity of the drill string and downhole tools connected thereto. In the case of Moineau-type motors, the motion and interaction between various components can be both mechanically complex and stressful.

DESCRIPTION OF DRAWINGS

Like reference symbols in the various drawings indicate like elements.

DETAILED DESCRIPTION

Figure 1:
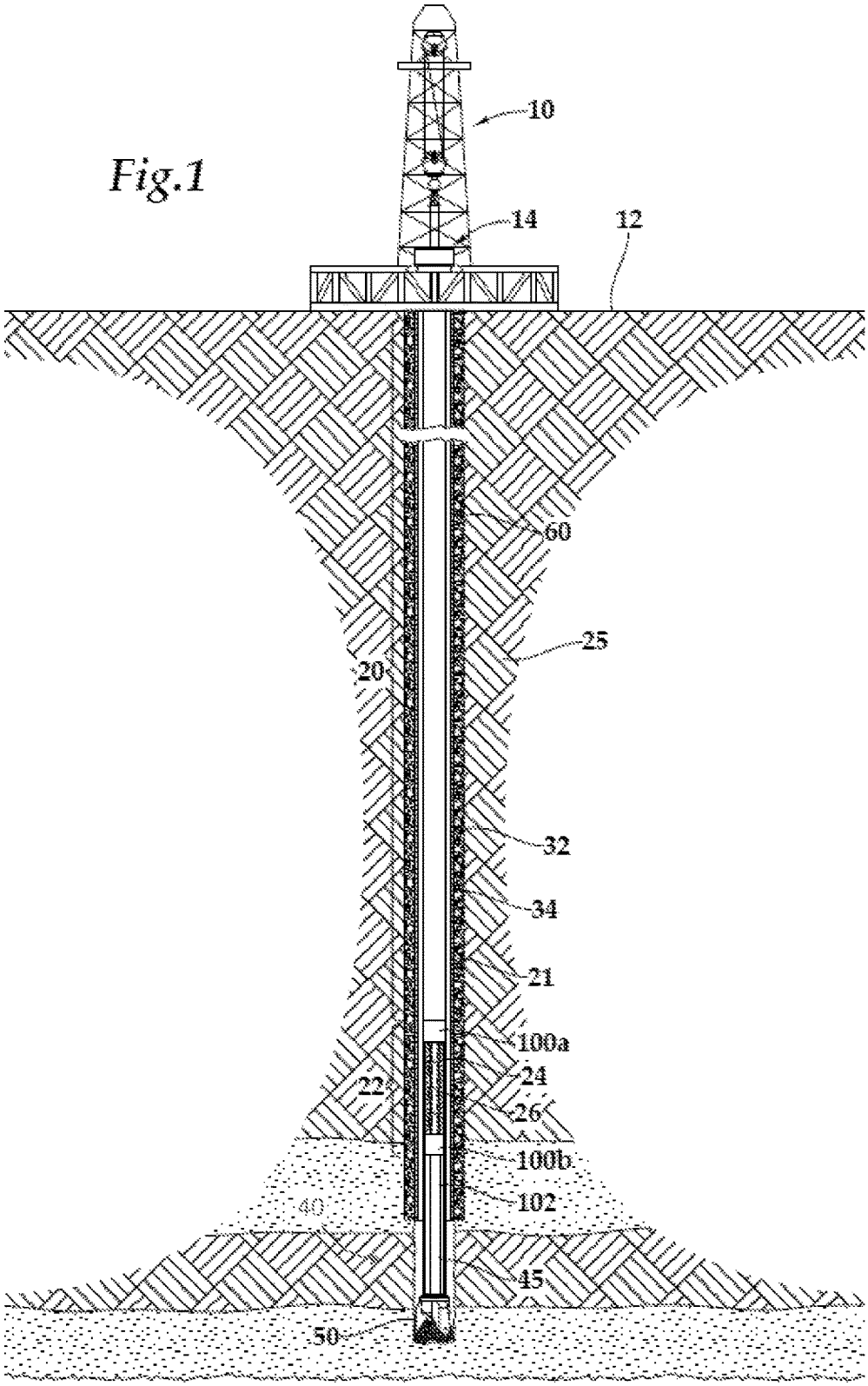
FIG. 1 is a schematic illustration of a drilling rig and downhole equipment including a downhole drilling motor disposed in a wellbore.

Referring to FIG. 1, in general, a drilling rig 10 located at or above the surface 12 rotates a drill string 20 disposed in a wellbore 60 below the surface 12. The drill string 20 typically includes a drill pipe 21 connected to a upper saver sub of a downhole positive displacement motor (e.g., a Moineau type motor), which includes a stator 24 and a rotor 26 that generate and transfer torque down the borehole to a drill bit 50 or other downhole equipment (referred to generally as the "tool string") 40 attached to a longitudinal output shaft 45 of the downhole positive displacement motor. The surface equipment 14 on the drilling rig rotates the drill string 20 and the drill bit 50 as it bores into the Earth's crust 25 to form a wellbore 60. The wellbore 60 is reinforced by a casing 34 and a cement sheath 32 in the annulus between the casing 34 and the borehole wall. During the normal operation, the rotor 26 of the power section is rotated relative to the stator 24 due to a pumped pressurized drilling fluid flowing through a power section 22 (e.g., positive displacement mud motor). Rotation of the rotor 26 rotates an output shaft 102, which is used to energize components of the tool string 40 disposed below the power section. The surface equipment 14 may be stationary or may rotate the motor 22 and therefore stator 24 which is connected to the drill string 20.

Energy generated by a rotating shaft in a downhole power section can be used to drive a variety of downhole tool functions. Components of the tool string 40 may be energized by the mechanical (e.g., rotational) energy generated by the power section 22, e.g., driving a drill bit or driving an electrical power generator. Dynamic loading at the outer mating surfaces of the rotor 26 and the stator 24 during operation can result in direct wear, e.g., abrasion, at the surface of the materials and can produce stress within the body of the materials.

Dynamic mechanical loading of the stator by the rotor can also be affected by the mechanical loading caused by bit or formation interactions, e.g., the rotor 26 can be effectively connected to the drill bit 50 by the output shaft 102. This variable mechanical loading can cause fluctuations in the mechanical loading of the stator 24 by the rotor 26, which can result in operating efficiency fluctuations.

By inserting a bearing assembly 100*a*, 100*b* at each end of the rotor 26 between the rotor 26 and the stator 24 the relative motion between the rotor 26 and the stator 24 can be accurately controlled or constrained for the driven function, thereby improving overall performance of the function. In some cases, controlling or constraining the relative motion can reduce mechanical stress and wear. For example, regulation of the dynamic loading between the rotor 26 and the stator 24 through the use of the bearing assemblies 100*a*, 100*b* can provide control of the dynamic centrifugal loading between the rotor 26 and the stator 24, and can thereby reduce the negative effects associated with such loading and improve component reliability and longevity.

Figure 2:
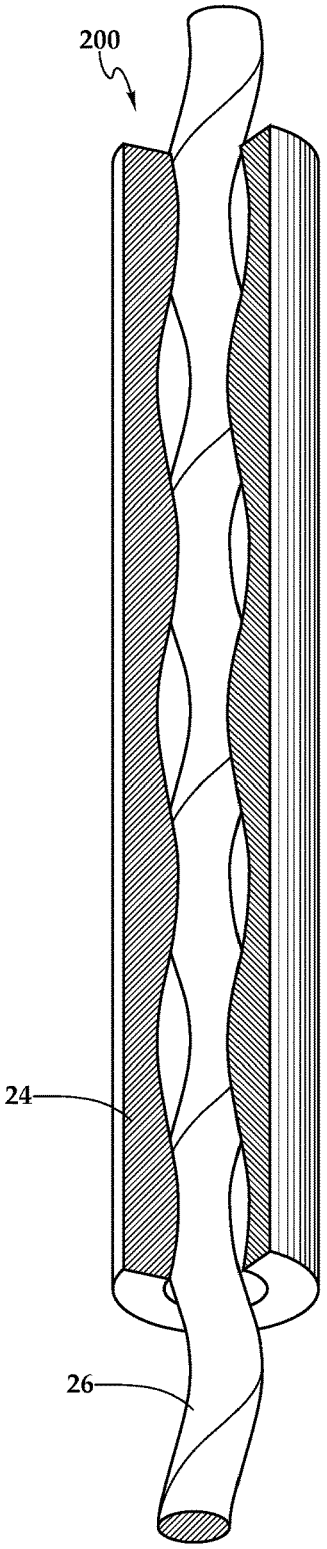
FIG. 2 is a cutaway perspective view of a rotor and stator of a downhole drilling motor.

FIG. 2 is a cutaway partial perspective view 200 of the example rotor 26 and the example stator 24. In some implementations, positive displacement progressing cavity downhole drilling motors can convert the hydraulic energy of pressurized drilling fluid, which is introduced between the rotor 26 and the stator 24, into mechanical energy, e.g., torque and rotation, to drive the downhole tool string 40 (e.g., drill bit 50) of FIG. 1.

In operation, the rotor 26 rotates on its own axis 305 and orbits around a central longitudinal axis 310 of the stator 24. A central longitudinal axis 305 of the rotor 26 moves eccentrically with respect to a central longitudinal axis 310 of the stator 24. The rotor 26 eccentricity follows a circle 317 that the longitudinal axis 305 of the rotor 26 traces about the longitudinal axis 310 of the stator 24. The eccentric orbit is in the opposite direction to the rotor rotation. For example, when rotor rotation is clockwise when observing from the top or inlet end of the motor, the orbit will be anti-clockwise.

Generally speaking, downhole drilling motors are based on a mated helically lobed rotor and helically lobed stator power unit, a transmission unit (e.g., multi-component universal joint type or single piece flexible shaft type), and a driveshaft assembly that incorporates thrust and radial bearings. In the examples of the rotor 26 and the stator 24, the rotor 26 includes a collection of helical rotor lobes 315 and the stator 24 includes a collection of helical stator lobes 320. The stator 24 has one or more stator lobes 320 than the rotor 26 has rotor lobes 315. When the rotor 26 is inserted into the stator 24, a collection of cavities 325 are formed. The number of the stator lobes 320 usually ranges from between two to ten lobes, although in some embodiments higher lobe numbers are possible.

As the rotor 26 rotates relative to the stator 24, the cavities 325 between the rotor 26 and stator 24 effectively progress along the length of the rotor 26 and stator 24. The progression of the cavities 325 can be used to transfer fluids from one end to the other. When pressurized fluid is provided to the cavities 325, the interaction of the rotor 26 and the stator 24 can be used to convert the hydraulic energy of pressurized fluid into mechanical energy in the form of torque and rotation, which can be delivered to downhole tool string 40 (e.g., the drill bit 50).

In some implementations, rotor and stator performance and efficiency can be affected by the mating fit of the rotor inside the stator. While in some embodiments, rotors and stators can function with clearance between the pair; in other embodiments an interference or compression fit between the rotor and stator may be provided to improve power production, efficiency, reliability, and/or longevity. For example, rotors and stators may be carefully measured and paired at workshop temperature while allowing for the effects of elastomer expansion caused by downhole geothermal heat and internally generated heat from within the motor as it functions.

In some examples, the overall efficiency of a progressing cavity power unit or pump can be a product of its volumetric efficiency and mechanical efficiency. The volumetric efficiency can be related to sealing and volumetric leakage (e.g., slip) between the rotor 26 and the stator 24, while the mechanical efficiency can be related to losses due to friction and fluid shearing between the rotor 26 and the stator 24. For example, during operation the overall efficiency of the rotor 26 and the stator 24 can be affected by drilling fluid viscous shearing, frictional losses at the stator 24, the rotating and orbiting mass of the rotor 26, and/or by the geometric interaction of the rotor lobes 315 and the stator lobes 320.

In the example of rotor 26 and the stator 24, the geometries of the rotor lobes 315 and the geometries of the stator lobes 320 are selected to reduce the amount of sliding movement between the rotor lobes 315 and the stator lobes 320 and increase the amount of rolling contact between the rotor 26 and the stator 24 when in use. In some implementations, such geometries can provide for good fluid sealing capability and can reduce mechanical loading and wear of the rotor 26 and the stator 24

In some implementations, there can be a direct relationship between the pressure differential applied across a downhole motor and the torque produced by the motor. The output RPM of the motor can be related to the volume of the progressing cavities 325 and how efficiently the rotor lobes 315 seal with the stator lobes 320. In some examples, in addition to the inner lobed profile of the stator 24 performing a sealing function when it interacts with the rotor 26, the inner lobed profile of the stator 24 can constrain the rotor 26 along its length, providing radial support, e.g., resistance to rotor 26 centrifugal forces. In some examples, however, excessive forces between the rotor 26 and the stator 24 can cause excessive stressing and wear of the rotor 26 and/or the stator 24

In some prior implementations of downhole motors, a transmission assembly or flexible shaft is used to negate the complex motion of the rotor into plain rotation at the upper end of the motor driveshaft. In such prior implementations, the rotating mass of the transmission assembly or flexible shaft may tend to negatively affect the sealing between the rotor and the stator and may negatively affect the mechanical loading of the rotor and stator lobes. By using bearing assemblies 100*a*, 100*b* of FIG. 1 to support the rotor 26, or at both ends, the dynamic loading of the stator 24 can be can be precisely regulated. By including one or more of the bearing assemblies 100*a*, 100*b*, the stator 24 fluid sealing efficiency can be increased thereby reducing fluid leakage, rather than the stator 24 having to provide sealing plus a significant radial support function.

In some embodiments, the rotor 26 helical lobe form directly contacts an internal helical lobe form which has been produced on the bore of the stator 24 and cavities 325 exist between the mating pair.

It is desirable to drill reliably for significant lengths of time over long borehole lengths at temperatures exceeding approximately 200 degrees C. (392 deg. F.). In some embodiments, the provision of additional radial support to the rotating and orbiting rotor 26, and regulation of the mechanical loading and wear of the stator lobes 320, can further enhance power unit reliability and longevity at high downhole operating temperatures.

Figure 4:
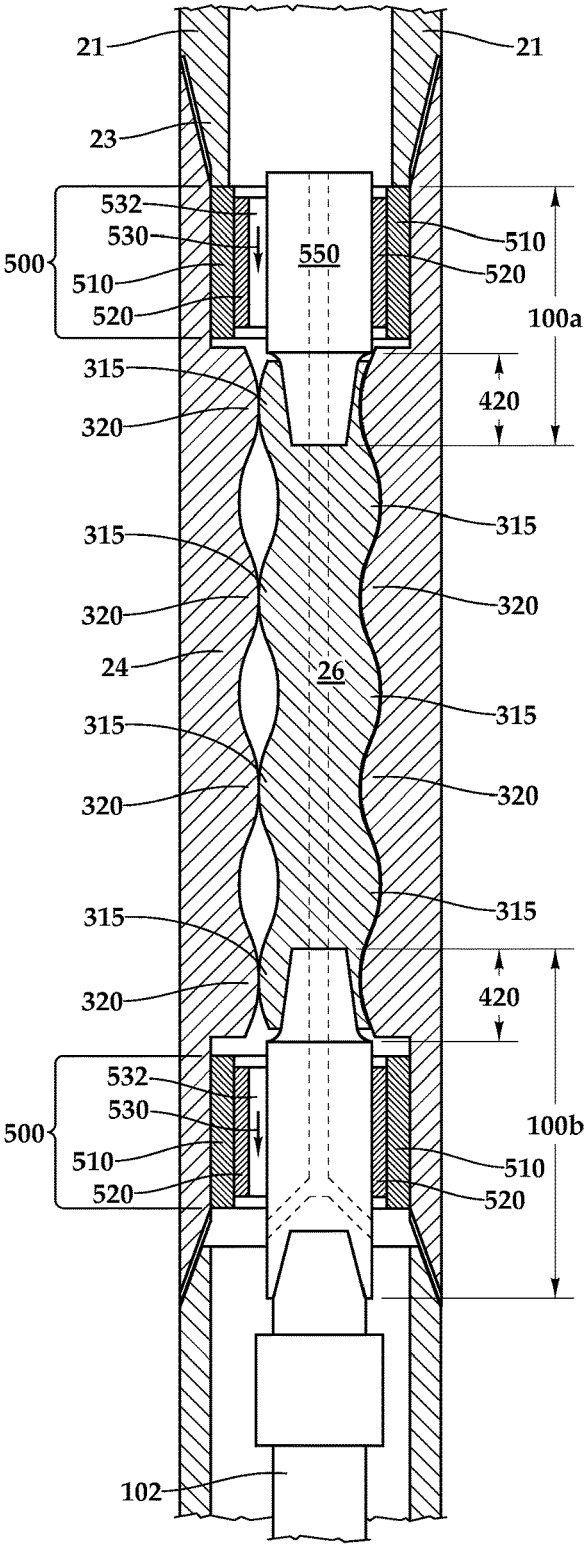
FIG. 4 is a partial side cross-sectional view of a downhole drilling motor with a first embodiment of a bearing assembly.

FIG. 4 is a partial sectional view 400 of the drilling motor 22, which includes the rotor 26 and the stator 24 along with the pair of bearing assemblies 100*a*, 100*b*. The bearing assemblies 100*a* and 100*b* both include a radial bearing 500 that will be discussed further in the description of FIG. 5. The drill string 20 is connected to the upper saver sub or the drill pipe 21 by a threaded connection 23 whereby when the drill string is rotated from above by the drilling rig, the housings of the drilling motor may be rotated with the drill string.

The bearing assembly 100*a* is positioned in an upper portion of the stator housing 624. The bearing assembly allows the rotor end extension 550 (or simply the end of the rotor) to rotate and orbit in the interior of the bearing (see FIG. 5). As illustrated in this embodiment a rotor end extension 550 is also coupled to the end of the rotor using a coupler assembly 420. Use of rotor end extensions allows for removal and repair to the rotor end extension that is in contact with the interior surface of the bearing and is subject to wear, without the need to remove the entire rotor from the motor and machine or resurface the end of the rotor. The rotor end assembly may be coupled to the rotor using conventional pin and box screwed connections or may use heat shrink or other known coupling methods.

Figure 5:
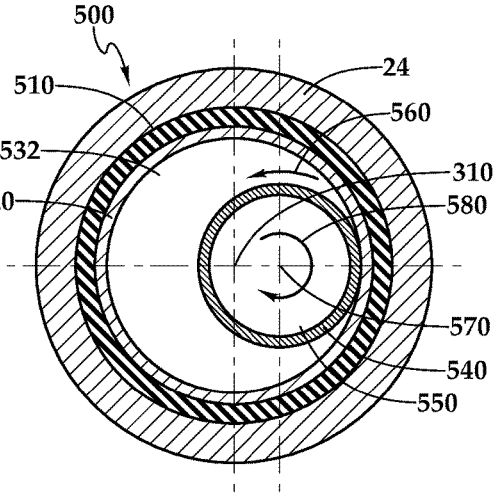
FIG. 5 is a transverse cross-sectional view of the bearing assembly of FIG. 4.

Pressurized drilling fluid flows between the rotor end and the interior of the bearing assembly 100*a* through the cavity 532 between the rotor and stator and in cavity 532 between a lower rotor end extension and the lower bearing assembly 100*b* as illustrated by flow arrows 530 in FIGS. 4 and 5. As will be discussed later, in connection with FIG. 5, the bearing assembly 100*a* allows pressurized drilling fluid supplied by the drill string to the motor to pass through and energize the rotor 26.

In some implementations, the bearing assemblies 100*a*, 100*b* can be configured to carry at least part of the radial and/or axial loading that can cause the aforementioned excessive forces between the rotor 26 and the stator 24. For example, the stator 24 may be a relatively thin walled steel housing and the rotor 26 operating inside may be relatively stiff. Considerable weight may be applied to the drill bit 50 or other downhole tools in the tool string 40 from the surface via the drill string 20 through the stator 24, which can cause the stator 24 to flex or bend. This flexing or bending can negatively affect the rotor 26 and the stator 24 sealing efficiency, and can cause irregular mechanical loads. In examples such as these and others, the bearing assemblies 100*a*, 100*b* can be implemented to support at least some of the unwanted axial and/or radial loads and prevent such loads from being transferred to the rotor 26 and/or the stator 24, thereby improving their operation.

Although in the view 400 the bearing assemblies 100*a*, 100*b* are placed at each end of the rotor 26, in some embodiments a single bearing assembly can be placed at either end of the rotor 26. In some embodiments, an "in-board" adaptation of the bearing assemblies 100*a* or 100*b* may also be placed at a position along the length of the rotor 26, the outer geometric profile of the rotor 26 being adapted as needed in the area of the "in-board" radial bearing.

In some embodiments, the bearing assemblies 100*a*, 100*b* may be used with multiple shorter length rotor and stator pairs in modular power section configurations. For example, two or more drilling motor power sections 22 can be connected in series to allow the use of relatively shorter rotors and stators. In some examples, relatively shorter rotors and stators may be less prone to torsional and bending stresses than relatively longer and more limber rotor/stator embodiments.

FIG. 5 is a cross-sectional view of the first embodiment of a radial bearing 500 as illustrated in FIG. 4. In some implementations, the radial bearing 500 can be utilized in a drilling operation as illustrated in FIG. 1. In general, the radial bearing 500 implements concentric rotor end location areas for concentrically mounted rotor end extensions, e.g., the extensions are concentric and/or aligned with the central longitudinal axis of the rotor.

The radial bearing 500 includes a bearing housing 510. The bearing housing 510 is formed as a cylinder, the outer surface of which contacts the cylindrical inner surface of the stator 24. An outer bearing surface 520 is formed as a cylinder about the cylindrical inner surface of the bearing housing 510.

The radial interior of the outer bearing surface 520 provides a cavity 532. Within the cavity 532, the radial bearing 500 includes an inner bearing 540. The inner bearing 540 is formed as a cylinder with an outer diameter lightly smaller than the inner diameter of the outer bearing 520, and an inner diameter formed to couple to a rotor end extension 550, such as the rotor 26 of FIG. 1. The rotor end extension 550 is removably coupled to an end of the rotor, and has a cylindrical portion with an outside diameter sized to rotatably fit inside the diameter of the cavity 532.

In the illustrated configuration of the radial bearing 500, drilling fluid can be pumped through the cavity 532 past the inner bearing 540 to energize the rotor. The flow of fluid, as indicated by the flow arrows 530, causes the rotor to rotate and nutate within the stator 24. The rotor end extension 550, connected to the moving rotor, is substantially free to orbit, and/or otherwise move eccentrically within the inner surface of the outer bearing 520 about the central longitudinal axis 310 of the stator 24, as generally indicated by the arrow 560. The rotor end extension 550 rotates about a central longitudinal axis 570 of the rotor, as generally indicated by the arrow 580. In some embodiments, contact between the outer bearing 520 and the inner bearing 540 can be lubricated by the drilling fluid (e.g., mud) being pumped through the cavity 532.

Figure 3:
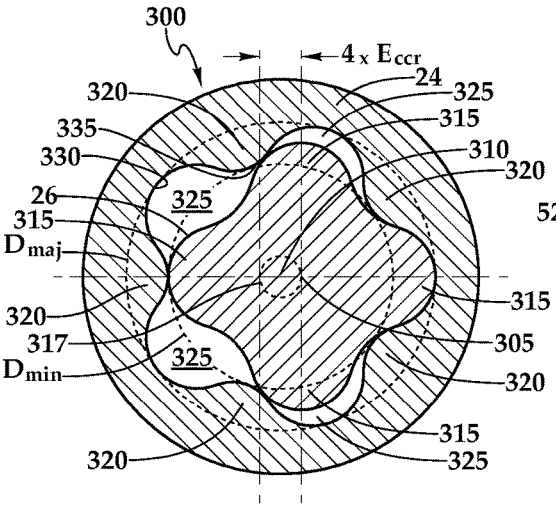
FIG. 3 is a transverse cross-sectional view of a rotor and stator of a downhole drilling motor of FIG. 2.

The radial bearing 500 radially supports the eccentric motion of the rotor as indicated by the arrows 560 and 580, and offsets the dynamic rotor loading of stator lobes, e.g., the stator lobes 320 of FIG. 3. In some implementations, the radial bearing 500 can provide increased motor operating performance envelopes, e.g., increased efficiency, reduced rotor and/or stator 24 wear, reduced dynamic mechanical loading, e.g., reduced vibration, improved transmission of data from below the power section to above the power section, enhanced downhole operating temperature capabilities, improved reliability and/or longevity of downhole motor components and/or associated tool string 40 components.

The above embodiment design may be modified to construct and operate the motor without the inner bearing surface 540. In such a modified implementation the rotor extension would rotate and orbit in the opening of the outer bearing in the same path as described above with respect to the inner bearing. Use of an inner bearing has an advantage over this implementation because the inner bearing may be formed of material (e.g., material that is inherently harder or has been treated to be hardened) and is therefore more resistant to wear as the rotor extension contacts the inner surface of the opening in the outer bearing. Additionally, it can be faster and easier to replace or resurface the inner bearing surface 540 positioned on the rotor extension than to remove and resurface the rotor itself.

Alternatively, it may be possible to construct and operate the subject motor in an implementation without separate rotor extensions wherein a plain cylindrical end portion of the rotor would rotate and orbit in the opening of the outer bearings in the same path as described above in regards to the inner bearing surface 540. Use of rotor extensions has the advantage over this implementation of being able to be formed of material that is resistant to wear as the rotor contacts the inner surface of the opening in the outer bearing. Additionally, it can be easier and more economical to replace or resurface the rotor extension 550 than to remove the rotor and resurface the rotor plain cylindrical end portion.

Figure 6:
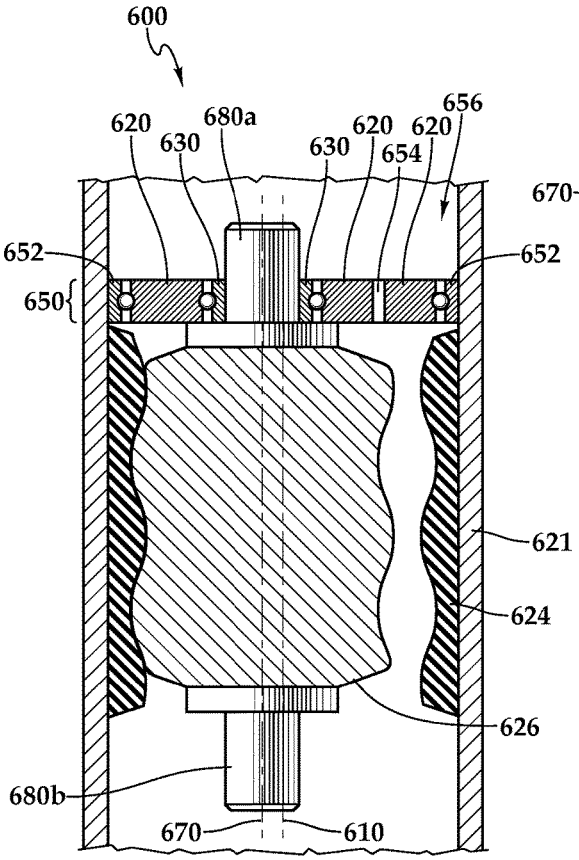
FIG. 6 is a partial side cross-sectional view of a downhole drilling motor with a second embodiment of a bearing assembly.

FIG. 6 is a sectional view of a power section 600 which includes a second embodiment of a bearing assembly. In some implementations, the power section 600 can be the power section 22 of FIG. 1. The power section 600 includes a rotor 626 and a stator 624. The stator 624 is formed along the cylindrical interior surface of a portion of the stator housing 621. The stator includes helical stator lobes that are formed to interact with corresponding rotor lobes formed on the outer surface of the rotor 626.

The rotor 626 includes a rotor end extension 680*a* at one end and a rotor end extension 680*b* at the other end. The rotor end extensions 680*a*, 680*b* are cylindrical shafts extending longitudinally from the ends of the rotor 626, and are substantially aligned with the longitudinal rotor axis 670. The longitudinal rotor axis 670 is radially offset from the longitudinal stator axis 610.

In operation the rotor 626 and the rotor end extensions 680*a*, 680*b* will move eccentrically relative to the longitudinal stator axis 610, e.g., rotate and orbit. Movement of the rotor end extension 680*a* is constrained by an eccentric radial bearing assembly 650.

The eccentric radial bearing assembly 650 includes an eccentric bearing housing 652, and an eccentric bearing 656. The eccentric bearing 656 includes an outer bearing 720 and an inner bearing 730. The outer bearing 720 includes one or more fluid ports 654. In use, drilling fluids can be pumped past the eccentric radial bearing assembly 650 though the fluid ports 654 to energize the rotor 626. The eccentric bearing housing 652 contacts the internal surface of the stator housing 624 to support an eccentric bearing 656. The axis of rotation of the inner bearing 730 is eccentrically offset to the stator housing 624 longitudinal axis 610. The rotor end extension 680*a* is supported by the inner bearing 730 of the eccentric bearing 656 such that the rotational movement of the rotor end extension 680*a* can be constrained and supported.

Figure 7:
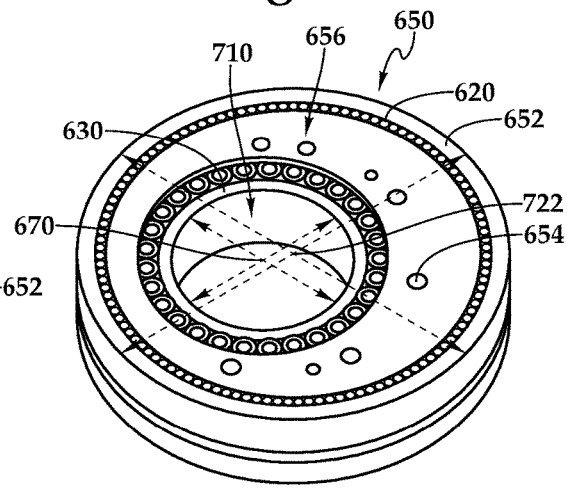
FIG. 7 is a perspective view of the eccentric bearing assembly of FIG. 6.

FIG. 7 is a perspective view of the second embodiment of a radial bearing assembly 650 of FIG. 6. The eccentric radial bearing assembly 650 includes the eccentric bearing housing 652 and the eccentric bearing 656. The eccentric bearing 656 includes a central opening 710 that is formed to accept and support a rotor end extension such as the rotor end extensions 680*a* or 680*b*.

The eccentric bearing 650 includes the outer bearing 620 formed concentrically within the eccentric bearing housing 652. The outer bearing 620 is free to rotate about the longitudinal stator axis 610 of the bearing assembly 650 and stator housing 624. The outer bearing 620 includes a collection of fluid flow ports 654, however in some embodiments fluid ports may also be incorporated in bearing housing 652.

The inner bearing 630 is formed eccentrically within the outer bearing 620. The inner bearing 630 is free to rotate about the longitudinal rotor axis 670, which is radially offset from the longitudinal stator axis 610. The rotation of inner bearing 630, which is eccentrically mounted with respect to outer bearing 620, plus the coincident rotation of outer bearing 620, permits rotation of the rotor 626 around the longitudinal rotor axis 670 while it orbits in the opposite direction around the longitudinal stator axis 610 of the stator housing 624, subject to the constraints of the outer bearing 620.

In use, the rotor 626 is assembled to the eccentric radial bearing assembly 650. In some embodiments, the rotor end extension 680*a* can be supported all around the full 360 degrees of extension circumference within the central opening 710 of the eccentric bearing assembly 650. The rotor 626 can rotate with the inner bearing 630 of the eccentric bearing 656, and can also move eccentrically (e.g., orbit) with respect to the outer bearing 620, which is mounted substantially concentric with respect to the longitudinal stator axis 610.

In some embodiments, the inner bearing 630 and/or the outer bearing 620 may be sealed (e.g., oil or grease lubricated) or unsealed (e.g., drilling fluid lubricated) multi-element (e.g., balls, rollers) eccentric bearings. In some embodiments, the inner bearing 630 and/or the outer bearing 620 may be plain cylindrical or ring bearings.

In some embodiments, the amount of eccentricity accommodated by eccentric radial bearing assemblies, such as the eccentric radial bearing assemblies 100*a*, 100*b*, 500, and 650, is relative to the amount of movement of the rotor within the stator. This relative relationship can be equal to half a lobe depth radially, or a total of one lobe depth diametrically. In some embodiments, the rotor eccentricity can be related to the radial movement of the axis of the rotor relative to the axis of the stator, as the axis of the rotor moves during rotor orbiting of the central axis of the stator. In some implementations, the depth of one lobe can be equal to 4× the eccentricity of the rotor.

The amount of eccentricity accommodated by eccentric radial bearing assemblies, such as bearing assemblies 100*a*, 100*b*, 500, and 650, is relative to the amount of movement of the rotor within the stator. The rotor eccentricity can be related to the radial movement of the longitudinal axis of the rotor relative to the longitudinal axis of the stator, as the longitudinal axis of the rotor moves during rotor orbiting of the longitudinal axis of the stator. The depth of one lobe can approximate 4× the eccentricity.

In Referring again to FIG. 3, consider a major diameter (Dmaj) and a minor diameter (Dmin). In this example, Dmaj is defined by the diameter of a circle which radially circumscribes a collection of the outermost points 330 of the stator lobes at the lobe 'troughs'. In this example, Dmin is defined by the diameter of a circle which circumscribes the radially innermost points 335 of the stator lobes at the lobe 'crests'. In some embodiments, the eccentricity of a mated rotor and stator pair can be a function of the major diameter Dmaj and the minor diameter Dmin. In such examples, the eccentricity of a mated rotor and stator pair, where the stator has more than one lobe, can approximate (Dmaj−Dmin)/4, and the centrifugal force (Fc) of the rotor can be a product of the mass (M) of the rotor multiplied by the rotational speed squared (v2), multiplied by the eccentricity (Eccr), e.g., Fc=M×v2×Eccr.

Figure 8:
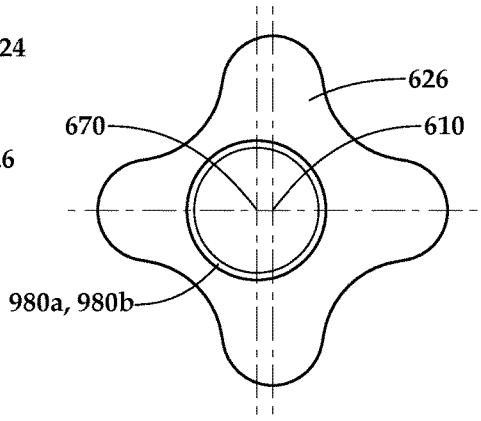
FIG. 8 is an end view of the rotor end extension of FIG. 6.
Figure 9:
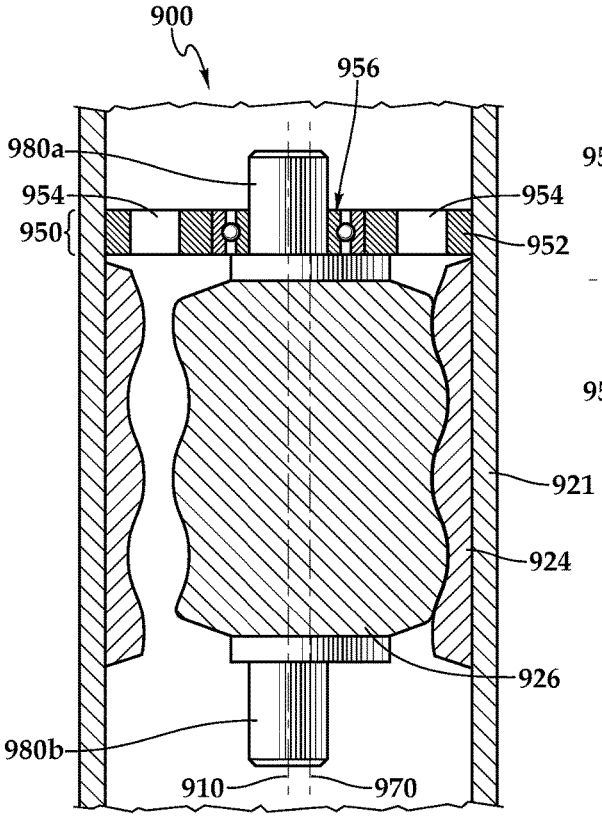
FIG. 9 is a side view of a third embodiment of a bearing assembly.

FIG. 8 is an end view of the rotor end extension 980*a* or 980*b* of FIG. 9 with the bearing removed for clarity. The rotor 626 has a lobed, substantially symmetrical shape in cross-section, having the axis 610 at its longitudinal center. The rotor end extension 980*a* is substantially circular in cross-section, having the axis 670 at its longitudinal center. The axis 670 is radially offset from the axis 610.

Figure 10:
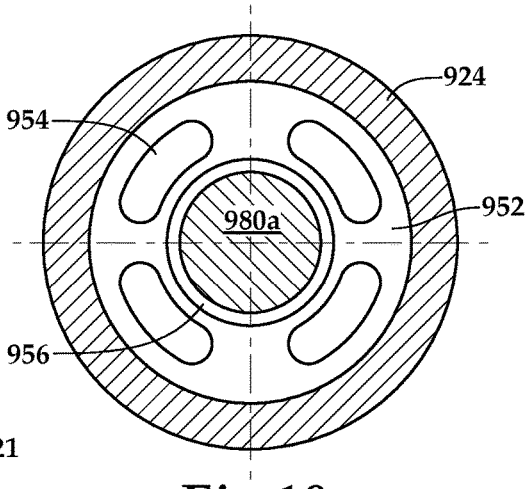
FIG. 10 is a partial transverse cross-sectional view of the third embodiment of the bearing assembly of FIG. 9.

In use, the rotor end extension 980*a* is assembled into an inner bearing 956 of FIG. 10. The inner bearing provides support around the circumferential surface of the rotor end extension 980*a*. FIG. 9 is a sectional view of a power section 900 that includes a third embodiment of a bearing assembly. In some implementations, the power section 900 can be the power section 22 of FIG. 1. The power section 900 includes a rotor 926 and a stator 924. The stator is formed along the radially interior surface of a portion of the stator housing 921. The stator includes helical stator lobes that are formed to interact with corresponding rotor lobes formed in the rotor 926.

The rotor 926 includes a rotor end extension 980*a* at one end and a rotor end extension 980*b* at the other end. The rotor end extensions are substantially cylindrical shafts extending from the ends of the rotor 926. Each extension is positioned such that the longitudinal axis of each is eccentrically offset with respect to the longitudinal rotor axis 970 and aligned with the longitudinal stator axis 910 of the power section 900.

In operation, the rotor 926 will orbit eccentrically relative to the stator 924. Movement of the rotor end extension 980*a* is constrained by a radial bearing assembly 950. The rotor extensions 980*a* and 980*b* rotate in alignment with the longitudinal axis 910 of the stator.

The radial bearing assembly 950 includes a bearing housing 952. The bearing housing 952 includes one or more fluid ports 954. In use, drilling fluids can be pumped past the radial bearing assembly 950 though the fluid ports 954 to energize the rotor 926. The bearing housing 952 contacts the inner surface of the stator 924 to support a bearing 956 at a radial midpoint within the interior of the stator 924.

FIG. 10 is a cross-sectional view of the example bearing assembly 950. In some implementations, the bearing assembly 950 can be the bearing assembly 100*a* or 100*b* of FIG.

1. The bearing assembly 950 includes the concentric bearing housing 952 located within the bore of the stator 924. The bearing is positioned concentrically with respect to the bore of stator 924. The axis of rotation of the bearing is aligned with the stator 924 longitudinal axis. The bearing 956 is positioned between the concentric bearing housing 952 and the rotor end extension 980*a* inserted within a central opening in the bearing 956.

The concentric bearing housing 952 includes fluid ports 954. In some implementations, the fluid ports 954 can allow drilling or other fluids to pass by the bearing assembly 950. In use, a rotor is assembled to the rotor end extension 980*a*. In some embodiments, the rotor end extension 980*a* can be supported all around the full 360 degrees of extension circumference within the central opening of the bearing 950. The rotor 926 can rotate with the bearing 950. In some embodiments, the rotor end extension 980*a* may be connected to an eccentric bearing that moves eccentrically with the rotor 926. In some embodiments, the rotor end extension 980*a* may be connected to a rotor arm that substantially connects the central longitudinal axis 910 to a central longitudinal axis of rotation of the rotor 926.

Although a few implementations have been described in detail above, other modifications are possible. Moreover, other mechanisms for constraining the motion between components of a Moineau-type drilling motor, surface or sub-surface or pump may be used. Accordingly, other implementations are within the scope of the following claims.

What is claimed is:

1. A progressing cavity drilling motor positionable in a wellbore comprising:

a tubular housing having a first longitudinal end and a second longitudinal end;

a stator disposed in the tubular housing, said stator having a central longitudinal axis and a plurality of helical stator lobes;

a rotor having a central longitudinal axis and a first cylindrical end, said rotor having a plurality of helical rotor lobes, said stator lobes and rotor lobes defining a plurality of cavities between the rotor and stator, and said rotor located within the stator wherein the central longitudinal axis of the rotor orbits about the central longitudinal axis of the stator;

a first bearing assembly coupled to the first longitudinal end of the tubular housing and disposed around the first cylindrical end of the rotor, said first bearing assembly including:

a first bearing housing, disposed concentrically in the tubular housing, a first outer bearing having a radial interior outer bearing surface disposed concentrically in the first bearing housing, and a first inner bearing in contact with the radial interior outer bearing surface and disposed on the first cylindrical end of the rotor, said first inner bearing having a central longitudinal axis aligned with the central longitudinal axis of the rotor and said first inner bearing positioned in the first outer bearing such that the first inner bearing orbits around the central longitudinal axis of the stator when the rotor is rotated in the stator;

a second bearing assembly coupled to the second longitudinal end of the tubular housing and disposed around a second cylindrical end of the rotor, said second bearing assembly including:

a second bearing housing, disposed concentrically in the tubular housing, a second outer bearing disposed concentrically in the second bearing housing, and a second inner bearing disposed on the second cylindrical end of the rotor, said second inner bearing having a central longitudinal axis aligned with the central longitudinal axis of the rotor and said second inner bearing positioned in the second outer bearing such that the second inner bearing orbits about the central longitudinal axis of the stator when the rotor is rotated in the stator;

a first rotor end extension removably coupled to the first end of the rotor, said first rotor end extension having a cylindrical portion having an outer diameter sized to rotatably fit inside an inner diameter of the first inner bearing, wherein the first rotor end extension further comprises a first male end for removably coupling to a first female cavity in the first end of the rotor; and a second rotor end extension removably coupled to the second end of the rotor, said second rotor end extension having a cylindrical portion having an outer diameter sized to rotatably fit inside an inner diameter of the second inner bearing, wherein the second rotor end extension further comprises a second male end for removably coupling to a second female cavity in the second end of the rotor.

2. A progressing cavity drilling motor positionable in a wellbore comprising:

a tubular housing having a first longitudinal end and a second longitudinal end and a central longitudinal axis;

a stator disposed in the tubular housing, said stator having a central longitudinal axis and a plurality of helical stator lobes;

a rotor having a central longitudinal axis and a first rotor end, said rotor having a plurality of helical rotor lobes, said stator lobes and rotor lobes defining a plurality of cavities between the rotor and stator, and said rotor located within the stator wherein the central longitudinal axis of the rotor is offset from the central longitudinal axis of the stator, said rotor including a first rotor end extension coupled to the first rotor end, said first rotor end extension having a cylindrical portion having a central longitudinal axis concurrent with the central longitudinal axis of the rotor; and a first bearing assembly coupled to the first longitudinal end of the tubular housing, said first bearing assembly including:

a first outer bearing disposed concentrically in the tubular housing and having an opening therethrough, said opening having a central longitudinal axis offset from the central longitudinal axis of the tubular housing, and a first inner bearing disposed in the opening of the first outer bearing and said first inner bearing having an opening with a diameter sized to receive the cylindrical portion of the first rotor end extension, said first inner bearing having a central longitudinal axis aligned with the central longitudinal axis of the rotor.

3. The motor of claim 2 wherein the rotor further includes a second rotor end extension coupled to a second rotor end, said second rotor end extension having a cylindrical portion having a central longitudinal axis concurrent with the central longitudinal axis of the rotor, and wherein the longitudinal axes of the cylindrical portion of the first rotor end extension and the second rotor end extension are concurrently aligned; and a second bearing assembly coupled to the second longitudinal end of the tubular housing, said second bearing assembly including:

a second outer bearing disposed concentrically in the tubular housing having an opening therethrough, said opening having a central longitudinal axis offset from the central longitudinal axis of the tubular housing, and a second inner bearing disposed in the opening of the second outer bearing and said second inner bearing having an opening with a diameter sized to receive the cylindrical portion of the second rotor end extension, said inner bearing having a central longitudinal axis aligned with the central longitudinal axis of the rotor.

4. The motor of claim 2, wherein the first inner bearing further includes a rotatable sleeve positioned in the opening of the first inner bearing and said sleeve including an opening having a diameter sized to receive the cylindrical portion of the first rotor end extension.

5. The motor of claim 4 further including ball bearings or roller bearings disposed between the opening of the first inner bearing and the sleeve disposed therein.

6. The motor of claim 2 further including at least one fluid flow port through the outer bearing.

7. A progressing cavity drilling motor positionable in a wellbore comprising:

a tubular housing having a first longitudinal end and a second longitudinal end and a central longitudinal axis;

a stator disposed in the tubular housing, said stator having a central longitudinal axis and a plurality of helical stator lobes;

a rotor having a central longitudinal axis and a first end, said rotor having a plurality of helical rotor lobes, said stator lobes and rotor lobes defining a plurality of cavities between the rotor and stator, and said rotor located within the stator wherein the central longitudinal axis of the rotor is offset from the central longitudinal axis of the stator, said rotor including a first rotor end extension coupled to the first end of the rotor, said first rotor end extension having a cylindrical portion having a central longitudinal axis offset from the central longitudinal axis of the rotor;

a first bearing assembly coupled to the first longitudinal end of the tubular housing, said first bearing assembly including:

a first outer bearing having an opening therethrough, said opening having a central longitudinal axis concurrent with the central longitudinal axis of the central longitudinal axis of the tubular housing, and a first inner bearing disposed in the opening of the outer bearing and said first inner bearing having an opening with a diameter sized to receive the cylindrical portion of the first rotor end extension, said inner bearing having a central longitudinal axis aligned with the stator.

8. The motor of claim 7 wherein the rotor further includes a second rotor end extension coupled to a second end of the rotor, said second rotor end extension having a cylindrical portion having a central longitudinal axis offset from the central longitudinal axis of the rotor, and wherein the longitudinal axis of the cylindrical portion of the first rotor end extension and the second rotor end extension are concurrently aligned; and a second bearing assembly coupled to the second longitudinal end of the tubular housing, said second bearing assembly including:

a second outer bearing having an opening therethrough, said opening having a central longitudinal axis concurrent with the central longitudinal axis of the tubular housing, and a second inner bearing disposed in the opening of the second outer bearing and said second inner bearing having an opening with a diameter sized to receive a cylindrical portion of the second rotor end extension, said inner bearing having a central longitudinal axis aligned with the central longitudinal axis of the stator.

9. The motor of claim 7 further including at least one fluid flow port through the outer bearing.

10. A method for operating a progressing cavity drilling motor positionable in a wellbore comprising:

providing a progressing cavity drilling motor including:

a tubular housing having a first longitudinal end and a second longitudinal end;

a stator disposed in the tubular housing, said stator having a central longitudinal axis and a plurality of helical stator lobes;

a rotor having a central longitudinal axis and a first cylindrical end, said rotor having a plurality of helical rotor lobes, said stator lobes and rotor lobes defining a plurality of cavities between the rotor and stator, and said rotor located within the stator;

a first bearing assembly coupled to the first longitudinal end of the tubular housing and disposed around the first cylindrical end of the rotor, said first bearing assembly including:

a first bearing housing, disposed concentrically in the tubular housing, a first outer bearing having a radial interior outer bearing surface disposed concentrically in the first bearing housing, and a first inner bearing in contact with the radial interior outer bearing surface and disposed on the first cylindrical end of the rotor, said first inner bearing having a central longitudinal axis aligned with the central longitudinal axis of the rotor and the central longitudinal axis of said first inner bearing;

a second bearing assembly coupled to the second longitudinal end of the tubular housing and disposed around a second cylindrical end of the rotor, said second bearing assembly including:

a second bearing housing, disposed concentrically in the tubular housing, a second outer bearing disposed concentrically in the second bearing housing, and a second inner bearing disposed on a second cylindrical end of the rotor, said second inner bearing having a central longitudinal axis aligned with the central longitudinal axis of the rotor and said second inner bearing positioned in the second outer bearing; and a first rotor end extension removably coupled to the first end of the rotor, said first rotor end extension having a cylindrical portion having an outer diameter sized to rotatably fit inside an inner diameter of the first inner bearing, wherein the first rotor end extension further comprises a first male end for removably coupling to a first female cavity in the first end of the rotor; and a second rotor end extension removably coupled to the second end of the rotor, said second rotor end extension having a cylindrical portion having an outer diameter sized to rotatably fit inside an inner diameter of the second inner bearing, wherein the second rotor end extension further comprises a second male end for removably coupling to a second female cavity in the second end of the rotor; and rotating the rotor in the stator such that the central longitudinal axis of the rotor orbits about the central longitudinal axis of the stator and the central longitudinal axis of the first inner and second inner bearings orbit around the central longitudinal axis of the stator.

11. A method for operating a progressing cavity drilling motor positionable in a wellbore comprising:

providing a progressing cavity drilling motor including:

a tubular housing having a first longitudinal end and a second longitudinal end and a central longitudinal axis;

a stator disposed in the tubular housing, said stator having a central longitudinal axis and a plurality of helical stator lobes;

a rotor having a central longitudinal axis and a first end, said rotor having a plurality of helical lobes, said stator lobes and rotor lobes defining a plurality of cavities between the rotor and stator, and said rotor located within the stator;

a first bearing assembly coupled to the first longitudinal end of the tubular housing, said first bearing assembly including:

a first outer bearing disposed concentrically in the first bearing housing and having an opening therethrough, said opening having a central longitudinal axis offset from the central longitudinal axis of the tubular housing, and a first inner bearing disposed in the opening of the first outer bearing and said first inner bearing having an opening with a diameter sized to receive a cylindrical portion of a first rotor end extension, said first inner bearing having a central longitudinal axis aligned with the central longitudinal axis of the rotor; and rotating the rotor in the stator such that the first inner bearing orbits around the central longitudinal axis of the stator.

12. The method of claim 11 wherein the rotor further includes a second rotor end extension coupled to a second end of the rotor, said second rotor end extension having a cylindrical portion having a central longitudinal axis concurrent with the central longitudinal axis of the rotor, and wherein the central longitudinal axes of the cylindrical portion of the first rotor end extension and the second rotor end extension are concurrently aligned; and providing a second bearing assembly coupled to the second longitudinal end of the housing, said second bearing assembly including:

a second outer bearing disposed concentrically in the tubular housing having an opening therethrough, said opening having a central longitudinal axis offset from the central longitudinal axis of the central longitudinal axis of the tubular housing, and a second inner bearing disposed in the opening of the second outer bearing and said second inner bearing having an opening with a diameter sized to receive a cylindrical portion of a second rotor end extension, said inner bearing having a central longitudinal axis aligned with the central longitudinal axis of the rotor.

13. The method of claim 11 wherein the first inner bearing further includes a rotatable sleeve positioned in the opening of the first inner bearing and said sleeve including an opening having a diameter sized to receive the cylindrical portion of the first rotor end extension.

14. The method of claim 13 further including ball bearings or roller bearings disposed between the opening of the first inner bearing and the sleeve disposed therein.

15. The method of claim 11 further including:

providing at least one fluid flow port through the first outer bearing, and flowing a fluid through the at least one fluid flow port.

16. A method of operating a progressing cavity drilling motor positionable in a wellbore comprising:

providing a progressing cavity drilling motor including:

a tubular housing having a first longitudinal end and a second longitudinal end and a central longitudinal axis;

a stator disposed in the tubular housing, said stator having a central longitudinal axis and a plurality of helical stator lobes;

a rotor having a central longitudinal axis and a first end, said rotor having a plurality of helical stator lobes, said stator lobes and rotor lobes defining a plurality of cavities between the rotor and stator, and said rotor located within the stator; and a first bearing assembly coupled to the first longitudinal end of the tubular housing, said first bearing assembly including:

a first outer bearing having an opening therethrough, said opening having a central longitudinal axis concurrent with the central longitudinal axis of the tubular housing, and a first inner bearing disposed in the opening of the first outer bearing and said first inner bearing having an opening with a diameter sized to receive a cylindrical portion of a first rotor end extension, said first inner bearing having a central longitudinal axis aligned with the central longitudinal axis of the stator; and rotating the rotor in the stator such that the first inner bearing assembly orbits around the central longitudinal axis of the stator.

17. The method of claim 16 wherein the rotor further includes a second rotor end extension coupled to a second end of the rotor, said second rotor end extension having a cylindrical portion having a central longitudinal axis offset from the central longitudinal axis of the rotor, and wherein the central longitudinal axis of the cylindrical portion of the first rotor end extension and the central longitudinal axis of the second rotor end extension are concurrently aligned;

providing a second bearing assembly coupled to the second longitudinal end of the tubular housing, said second bearing assembly including:

a second outer bearing having an opening therethrough, said opening having a central longitudinal axis concurrent with the central longitudinal axis of the tubular housing, and a second inner bearing disposed in the opening of the second outer bearing and said second inner bearing having an opening with a diameter sized to receive a cylindrical portion of the second rotor end extension, said second inner bearing having a central longitudinal axis aligned with the central longitudinal axis of the stator; and rotating the rotor in the stator such that the second inner bearing assembly orbits around the central longitudinal axis of the stator.

18. The method of claim 16 further including:

providing at least one fluid flow port through the first outer bearing; and flowing a fluid through the at least one fluid flow port.

* * * * *